US009167914B2

(12) United States Patent
Rankin, VI et al.

(10) Patent No.: US 9,167,914 B2
(45) Date of Patent: Oct. 27, 2015

(54) ILLUMINATED MERCHANDISE DISPENSER

(71) Applicant: Vulcan Spring & Mfg. Co., Telford, PA (US)

(72) Inventors: Alexander Rankin, VI, Dresher, PA (US); Robert Gustafson, Collegeville, PA (US)

(73) Assignee: Vulcan Spring & Mfg. Co., Telford, PA (US)

( * ) Notice: Subject to any disclaimer, the term of this patent is extended or adjusted under 35 U.S.C. 154(b) by 0 days.

(21) Appl. No.: 14/285,167

(22) Filed: May 22, 2014

(65) Prior Publication Data

US 2014/0353265 A1 Dec. 4, 2014

Related U.S. Application Data

(60) Provisional application No. 61/829,488, filed on May 31, 2013.

(51) Int. Cl.

| | |
|---|---|
| ***A47F 1/12*** | (2006.01) |
| ***F21V 33/00*** | (2006.01) |
| ***A47F 11/10*** | (2006.01) |
| *F21K 99/00* | (2010.01) |
| *F21Y 103/00* | (2006.01) |
| *F21Y 101/02* | (2006.01) |

(52) U.S. Cl.

CPC ..... *A47F 1/126* (2013.01); *A47F 11/10* (2013.01); *F21V 33/0004* (2013.01); *F21K 9/00* (2013.01); *F21Y 2101/02* (2013.01); *F21Y 2103/003* (2013.01)

(58) Field of Classification Search

CPC ..... A47F 1/125; A47F 1/126; A47F 1/128

USPC ..... 211/51, 59.2, 59.3

See application file for complete search history.

(56) References Cited

U.S. PATENT DOCUMENTS

| | | | | |
|---|---|---|---|---|
| 5,649,363 | A | 7/1997 | Rankin, VI | |
| 5,743,428 | A | 4/1998 | Rankin, VI | |
| 5,964,373 | A * | 10/1999 | Hucknall | 221/6 |
| 6,155,438 | A * | 12/2000 | Close | 211/59.3 |
| 6,464,089 | B1 | 10/2002 | Rankin, VI | |
| 7,347,335 | B2 | 3/2008 | Rankin, VI et al. | |
| 7,792,711 | B2 * | 9/2010 | Swafford et al. | 705/28 |
| 8,083,078 | B2 * | 12/2011 | Omura et al. | 211/59.3 |
| 8,443,988 | B2 * | 5/2013 | Niederhuefner | 211/59.3 |
| 8,812,378 | B2 * | 8/2014 | Swafford et al. | 705/28 |
| 8,823,355 | B2 * | 9/2014 | Hachmann et al. | 324/73.1 |
| 8,910,801 | B2 * | 12/2014 | Johnson et al. | 211/59.3 |
| 8,941,495 | B2 * | 1/2015 | Wiese et al. | 340/568.8 |
| 2005/0040123 | A1 * | 2/2005 | Ali | 211/59.3 |
| 2005/0279722 | A1 * | 12/2005 | Ali | 211/59.3 |
| 2011/0304316 | A1 * | 12/2011 | Hachmann et al. | 324/76.11 |
| 2012/0279934 | A1 * | 11/2012 | Thomas et al. | 211/59.3 |
| 2013/0343014 | A1 * | 12/2013 | Browning et al. | 361/752 |

* cited by examiner

*Primary Examiner* — Stanton L Krycinski
(74) *Attorney, Agent, or Firm* — Howson & Howson LLP

(57) ABSTRACT

A merchandise dispenser is provided and has a product display tray with a bottom portion for supporting and guiding a rank of product items. The merchandise dispenser also has a spring assembly for advancing the product items forward on the bottom portion. The spring assembly includes a prestressed spiral tape having a top surface extending from a mounting end portion thereof and a plurality of light emitting diodes carried in spaced relation on a predetermined length of the top surface of the tape for upwardly illuminating product items when disposed in the product display tray.

18 Claims, 1 Drawing Sheet

ILLUMINATED MERCHANDISE DISPENSER

CROSS-REFERENCE TO RELATED APPLICATION

This application claims the benefit under 35 USC §119(e) of U.S. Provisional Patent Application No. 61/829,488, filed May 31, 2013.

BACKGROUND

The present invention relates to merchandise dispensers that advance a rank of products frontward in a tray as forwardmost products are removed in sequence.

An example of a merchandise dispenser that includes an adjustable spring-powered feature is disclosed in U.S. Pat. No. 6,464,089 to A. Rankin, V I. The patented Rankin mechanism includes a track mounting an upright pusher that slides along the track. The front of the pusher engages product packages. The pusher carries a spring that has a front end secured adjacent the front of the track and a coil section carried on the pusher. When the track is loaded with merchandise, the coil of the spring is wound and the wound spring provides stored energy that moves the pusher forward.

SUMMARY

In merchandising, lighting can be used effectively to emphasize product features, such as color, clarity and the like. Often, lighting is provided by track lights, such as light emitting diodes (LEDs) disposed in proximity with the front of the merchandise shelving. While track lighting is effective to provide illumination, there is a need for alternatives for efficient illumination of product and/or associated containers.

The present invention provides an efficient and effective manner of illuminating products by incorporating a strip of light emitting diodes (LEDs) with a spring tape to provide directed light onto the products closely adjacent the LEDs. When the product containers are clear, the light brightens the contents of the containers, and enables consumers to view the color of the contents prior to purchase. Novel effects can be achieved by directing light upwardly through the bottoms of clear containers.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION

Figure 1:
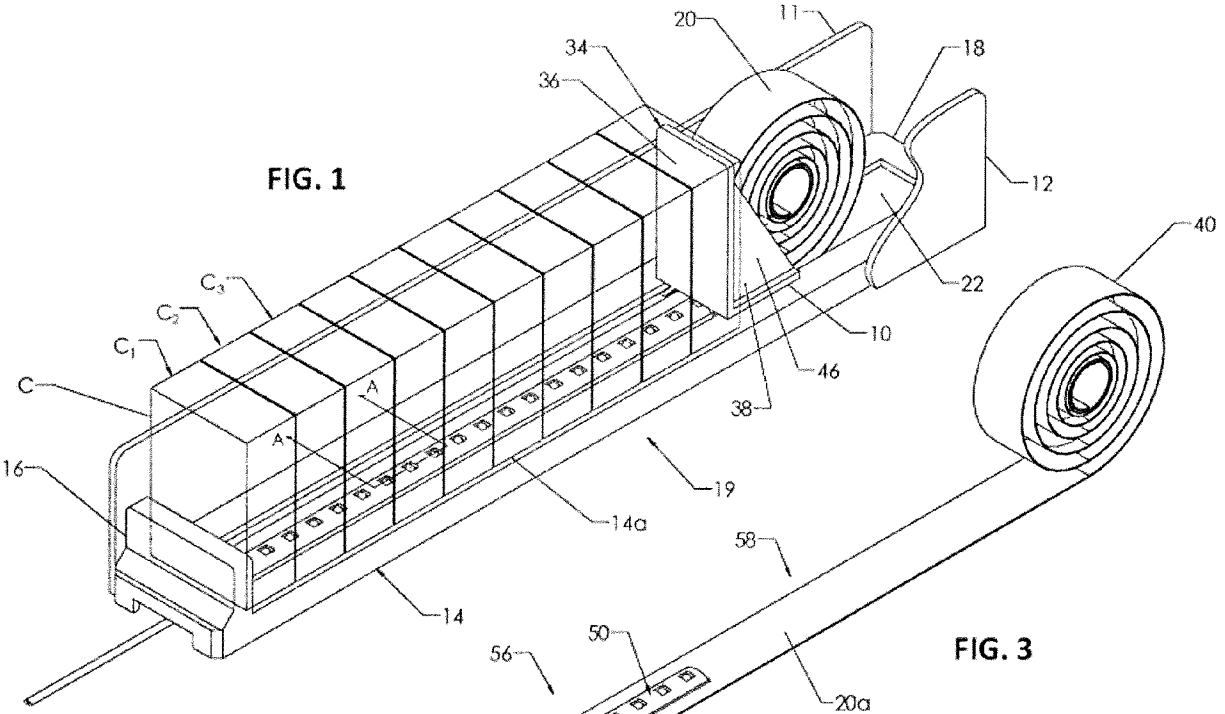
FIG. 1 is a perspective view of a spring powered merchandise display that incorporates an LED tape with a metal spring to illuminate a rank of products from below according to an embodiment.

FIG. 1 illustrates a spring-driven pusher tray 19 having a pair of upstanding parallel sidewalls 11, 12 for use in forward feeding merchandise items displayed on a shelf (not shown). For example, several containers of products are positioned in a single file row, or rank, one behind the other, in the tray 19 such that leading containers $C_1$, $C_2$, $C_3$, etc. are located at a front dispensing end of the tray 19. After, the leading box C, is removed from the tray 19 by a purchaser or store clerk, a pusher device 10 urges the rank of remaining containers $C_2$ and $C_3$, etc. forward to provide a new leading container adjacent the front end of the tray 19. Although not illustrated, the pusher device 10 of the present invention can also be utilized in up-feeding, side-feeding, or top-feeding merchandise dispensers.

The illustrated embodiment includes an elongate track 14 having a front dispensing end 16, an opposite rear end 18 and an elongate surface 14*a* supporting the row of containers. Containers are positioned on the track 14 in a row such that the leading article is located adjacent the front end 16 and the rearmost article is located adjacent the rear end 18 of the track 14. Alternatively, the track 14 can be mounted to extend above, or to the side of, the stacked articles on a substantially horizontal or slightly angled, shelf, or the track can be mounted vertically, or at a steep angle relative to the horizontal, for up-feeding a column of stacked articles to a dispensing end.

The pusher device 10 is mounted on the track 14 in a manner which permits movement of the pusher device 10 between the dispensing end 16 and the opposite end 18 of the track 14. Thus, the pusher device 10 is moved rearwardly, or toward the opposite end 18, to load a row of articles on a shelf and is resiliently biased forward, or toward the dispensing end 16, by a spring tape 20.

As best illustrated in FIG. 1, the track 14 includes an elongate slot 22 extending longitudinally, or lengthwise, and utilized to capture a flange extending from the pusher device 10. In this manner, the pusher device 10 engages the surface 14*a* of the track 14 and is free to slide in a straight path between the front dispensing and opposite rear ends, 16 and 18 respectively, of the track 14. Alternatively, the pusher device may have a pair of side flanges (not shown) which grip about the marginal side edges of the track. This configuration also permits the pusher device to slide in a straight path between the ends of the track.

The pusher device 10 includes a pusher plate 34 that extends upwardly and transversely from the track 14. The pusher plate 34 has a front surface 36 that engages the rearmost article of the row, or rank, of placed containers. The pusher plate 34 also includes spring retaining structure 38 which permits a coiled free end portion 40 of a self-coiling spring, or tape, 20 to be carried on a rear side of the pusher plate 34.

In the illustrated preferred embodiment, the spring retaining structure 38 is carried behind the pusher plate 34 between a pair of spaced apart, parallel retaining flanges, such as flange 46, which extend rearward from the rear side of the pusher plate 34. A terminal free end of the coiled end portion 40 can be either freely nested in the coil shown, or mounted on an arbor (not shown) that extends transversely with respect to the retaining flanges, and mounted to the retaining flanges. Preferably as illustrated, the coiled spring tape engages the rear side of the pusher plate 34 between the retaining flanges to push on the pusher plate, without requiring an arbor.

The free end 54 of an uncoiled portion 58 of the spring 20 remote from the coiled end portion 40 is connected to the track 14 adjacent its dispensing end 16, as by fasteners such as bolts, rivets, or the like. Thus, when the pusher plate 34 is moved rearwardly on the track 14, the spring uncoils and applies a force on the pusher plate 34 in a direction toward the front dispensing end 16 of the track 14, i.e. leftward in FIG. 1.

In a conventional dispenser, the spring tape, or force exerting mechanism, 20 is a flat metal self-coiling spring, or a pre-stressed flat strip of metal, which is formed in a spiral coiled condition. Examples of a metal self-coiling spring include a steel variable force spring or a steel power spring. The pushing force provided by the spring tape 20 preferably, but not necessarily, gradually decreases as the pusher plate approaches the front end 16 of the track 14 and as the spring tape 20 transitions from being fully extended in an un-coiled condition to being fully retracted in a coiled spiral condition. Thus, such a spring advantageously exerts a maximum force when the tray 19 is fully loaded with a full row of articles and exerts a progressively reduced amount of force as the leading articles of the row are removed one by one until all the articles are removed from the tray 19.

Figure 2:
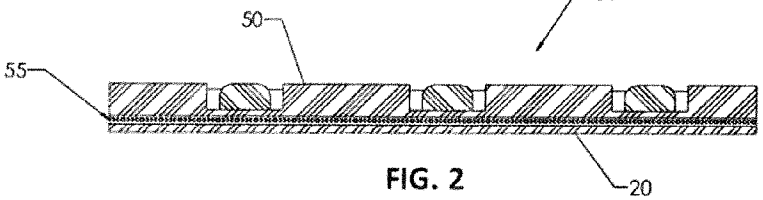
FIG. 2 is an enlarged, longitudinal cross-sectional view along plane A-A of FIG. 1 showing the LED strip adhesively secured to the metal spring.

The present invention provides a novel structure for illuminating the containers $C_1$, $C_2$, $C_3$, and so on, particularly near the front end of the tray which is most visible to the purchaser. To this end, a flexible strip 50 carrying a series of LEDs 51, 52, 53 in lengthwise spaced relation is secured to the topside 20*a* of the spring tape 20, as by a flexible adhesive 55. The LED strip 50 and adhesive 55 form a laminated spring assembly 56, illustrated in longitudinal cross-section in FIG. 2. The spring assembly 56 is flexible and capable of being coiled on itself into a spiral, as shown in FIG. 1. The spiral is formed to be somewhat open to accommodate the thickness of the LED strip as it winds onto itself into the coiled spiral configuration. Due to the LED strip being mounted on the upper, or topside of the spring tape, the LEDs face inwardly when coiled. Although the preferred spring tape is fabricated of metal by known processes, when lighter forces are capable of moving the product items, a so-called "plastic" tape spring may be adequate.

In use, the LEDs are connected in electrical parallel relation on their carrying strip, and power is provided to them via a pair of electrical conductors 57 extending from the mounting end 56*a* of the spring assembly in the manner illustrated in FIG. 1. The conductors may be connected to a low voltage electrical supply such as a battery, or an A.C. to D.C. power converter located remote from the display. When power is applied, the LEDs light-up and project light upward into the product items disposed above them on the track.

Figure 3:
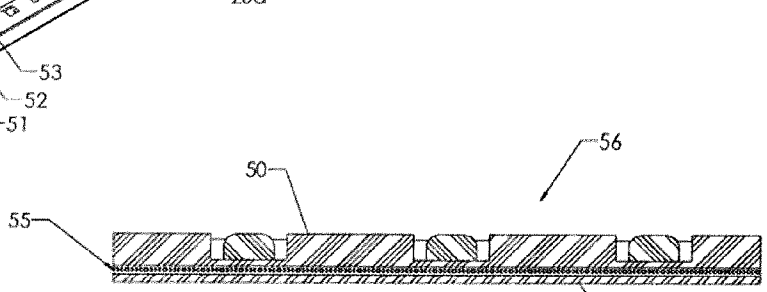
FIG. 3 is a perspective view, similar to FIG. 1, but illustrating a modified version of a spring assembly separated from the product tray according to an embodiment.

As illustrated in FIG. 1, the LEDs extend for a significant portion of the length of the spring tape, but need not do so. If desired merely to illuminate the frontmost items in the rank, the LED strip may be applied only adjacent the front mounting end 56*a* of the spring assembly 56, thereby leaving the coilable portion substantially free of LEDs behind the pusher in a region where illumination may not be either necessary or desirable. A construction of this type is illustrated in FIG. 3.

While preferred merchandise dispensers have been described in detail, various modifications, alterations, and changes may be made without departing from the spirit and scope of the present invention as defined in the appended claims.

The invention claimed is:

1. A dispenser, comprising:

a product display tray having a bottom portion for supporting and guiding a rank of product items; and a spring assembly for advancing the product items forward on the bottom portion;

said spring assembly comprising a pre-stressed spiral tape having a top surface extending from a mounting end portion thereof and a plurality of light emitting diodes carried in spaced relation on a predetermined length of said top surface of said tape for upwardly illuminating product items when disposed in the product display tray;

said plurality of light emitting diodes being mounted on an elongate flexible strip bonded to said tape; and said flexible strip having conductor wires extending from said mounting end portion of said tape.

2. A dispenser according to claim 1, wherein said pre-stressed spiral tape of said spring assembly is made of metal.

3. A dispenser according to claim 2, wherein said elongate flexible strip is bonded to said tape by means of a flexible adhesive.

4. A dispenser according to claim 3, wherein said plurality of light emitting diodes are wired in electrical parallel relation.

5. A dispenser according to claim 1, wherein said elongate flexible strip is bonded to said tape with an adhesive.

6. A dispenser according to claim 1, wherein said plurality of light emitting diodes is wired in electrical parallel relation.

7. A dispenser according to claim 1, wherein said flexible strip is located on said pre-stressed spiral tape such that said plurality of light emitting diodes emits light transversely of said pre-stressed spiral tape as said pre-stressed spiral tape is uncoiled.

8. A dispenser according to claim 1, wherein said flexible strip extends only partially along a length of said tape from said mounting end portion.

9. A dispenser according to claim 1, wherein said flexible strip extends along a majority of a length of said tape from said mounting end portion.

10. A dispenser, comprising:

a product display tray having a bottom portion for supporting and guiding a rank of product items; and a spring assembly for advancing the product items forward on the bottom portion;

said spring assembly comprising a pre-stressed spiral tape having a top surface extending from a mounting end portion thereof and a plurality of light emitting diodes carried in spaced relation on a predetermined length of said top surface of said tape for upwardly illuminating product items when disposed in the product display tray; and said plurality of light emitting diodes being wired in electrical parallel relation and having conductor wires extending from said mounting end portion of said tape.

11. A dispenser according to claim 10, wherein said pre-stressed spiral tape of said spring assembly is made of metal.

12. A dispenser according to claim 10, wherein said plurality of light emitting diodes is mounted on an elongate flexible strip secured to said tape.

13. A dispenser according to claim 12, wherein said elongate flexible strip is secured to said tape with an adhesive.

14. A dispenser according to claim 10, wherein said plurality of light emitting diodes extends only partially along a length of said tape from said mounting end portion.

15. A dispenser according to claim 10, wherein said plurality of light emitting diodes extends along a majority of a length of said tape from said mounting end portion.

16. A dispenser, comprising:

a product display tray having a bottom portion for supporting and guiding a rank of product items; and a spring assembly for advancing the product items forward on the bottom portion;

said spring assembly comprising a pre-stressed spiral metal tape having a top surface extending from a mounting end portion thereof and a plurality of light emitting diodes carried in spaced relation on a predetermined length of said top surface of said metal tape for upwardly illuminating product items when disposed in the product display tray;

said plurality of light emitting diodes being mounted on an elongate flexible strip adhesively secured to said tape;

said plurality of light emitting diodes being wired in electrical parallel relation; and said flexible strip having conductor wires extending from said mounting end portion of said metal tape.

17. A dispenser according to claim 16, wherein said flexible strip extends only partially along a length of said metal tape from said mounting end portion.

18. A dispenser according to claim 16, wherein said flexible strip extends along a majority of a length of said metal tape from said mounting end portion.

* * * * *